US009416692B2

(12) United States Patent
Yang

(10) Patent No.: US 9,416,692 B2
(45) Date of Patent: Aug. 16, 2016

(54) AUXILIARY VALVE ACTUATING MECHANISM OF ENGINE

(75) Inventor: Zhou Yang, Oak Ridge, NC (US)

(73) Assignee: Shanghai Universoon Autoparts Co., Ltd., Shanghai (CN)

( * ) Notice: Subject to any disclaimer, the term of this patent is extended or adjusted under 35 U.S.C. 154(b) by 202 days.

(21) Appl. No.: 13/978,366

(22) PCT Filed: May 3, 2011

(86) PCT No.: PCT/CN2011/000769

§ 371 (c)(1),
(2), (4) Date: Jul. 3, 2013

(87) PCT Pub. No.: WO2012/092693

PCT Pub. Date: Jul. 12, 2012

(65) Prior Publication Data

US 2013/0269653 A1 Oct. 17, 2013

(30) Foreign Application Priority Data

Jan. 5, 2011 (CN) ..... 2011 1 0001373

(51) Int. Cl.
*F02D 9/06* (2006.01)
*F01L 13/06* (2006.01)
(Continued)

(52) U.S. Cl.
CPC ..... *F01L 13/06* (2013.01); *F01L 1/181* (2013.01); *F01L 13/0026* (2013.01); *F01L 13/065* (2013.01); *F02D 9/06* (2013.01); *F02D 13/0276* (2013.01); *F02D 13/04* (2013.01);
(Continued)

(58) Field of Classification Search
CPC ..... F01L 13/06; F01L 1/267; F01L 13/0026; F01L 13/0021; F01L 1/18; F01L 1/185
USPC ..... 123/323, 90.1, 90.15, 90.16
See application file for complete search history.

(56) References Cited

U.S. PATENT DOCUMENTS 1,812,787 A 6/1931 Haston
3,220,392 A 11/1965 Cummins
(Continued)

FOREIGN PATENT DOCUMENTS

CN 201507333 U * 6/2010
CN 201513208 U 6/2010
(Continued)

OTHER PUBLICATIONS

ISR for application No. PCT/CN2011/000769, mailing date Oct. 20, 2011, 6 pgs.
(Continued)

*Primary Examiner* — Marguerite McMahon
*Assistant Examiner* — James Kim
(74) *Attorney, Agent, or Firm* — RuyakCherian LLP

(57) ABSTRACT

An auxiliary valve actuating mechanism of an engine includes a first valve actuating mechanism and an auxiliary valve actuating mechanism. The auxiliary valve actuating mechanism comprises an auxiliary cam, an auxiliary rocker-arm shaft, an auxiliary rocker arm, an eccentric rocker arm bushing and a bushing actuation device. One end of the auxiliary rocker arm constitutes a motion pair with the auxiliary cam and the other end is above the valve. The bushing actuation device actuates the eccentric rocker arm bushing to rotate between an operating position and a non-operating position.

7 Claims, 2 Drawing Sheets

(51) Int. Cl.

| | |
|---|---|
| ***F01L 1/18*** | (2006.01) |
| ***F01L 13/00*** | (2006.01) |
| ***F02D 13/02*** | (2006.01) |
| ***F02D 13/04*** | (2006.01) |
| *F01L 1/08* | (2006.01) |
| *F01L 1/20* | (2006.01) |
| *F01L 1/26* | (2006.01) |

(52) U.S. Cl.
CPC ... *F01L 1/08* (2013.01); *F01L 1/18* (2013.01); *F01L 1/185* (2013.01); *F01L 1/20* (2013.01); *F01L 1/267* (2013.01); *F01L 13/0021* (2013.01); *F01L 2105/00* (2013.01); *F01L 2800/10* (2013.01)

(56) References Cited

U.S. PATENT DOCUMENTS

| | | | | |
|---|---|---|---|---|
| 3,367,312 | A | 2/1968 | Jonsson | |
| 5,335,636 | A | 8/1994 | Bilei et al. | |
| 5,388,552 | A * | 2/1995 | Sugimoto et al. | 123/90.16 |
| 5,647,319 | A | 7/1997 | Uehara et al. | |
| 5,655,499 | A * | 8/1997 | Uehara et al. | 123/321 |
| 6,422,186 | B1 * | 7/2002 | Vanderpoel | F01L 1/181 123/90.15 |
| 6,450,144 | B2 * | 9/2002 | Janak | F01L 1/181 123/321 |
| 7,146,966 | B2 * | 12/2006 | Nakamura | 123/481 |
| 2002/0174849 | A1 * | 11/2002 | Ruggiero | F01L 13/06 123/319 |
| 2005/0211206 | A1 * | 9/2005 | Ruggiero et al. | 123/90.16 |
| 2012/0298057 | A1 * | 11/2012 | Janak | F01L 1/08 123/90.12 |
| 2014/0251266 | A1 * | 9/2014 | Emmons | F02D 13/04 123/321 |

FOREIGN PATENT DOCUMENTS

| | | | |
|---|---|---|---|
| CN | 201513210 | U | 6/2010 |
| CN | 201581950 | U | 9/2010 |
| CN | 201666172 | U | 12/2010 |
| CN | 201924986 | U | 8/2011 |
| DE | 348023 | C | 2/1922 |
| DE | 19830168 | A1 | 1/2000 |
| EP | 2261472 | A1 | 12/2010 |
| GB | 750441 | A | 6/1956 |
| GB | 1279977 | A | 6/1972 |
| JP | 08-074347 | | 3/1996 |
| JP | 2004068660 | A | 3/2004 |

OTHER PUBLICATIONS

European Search Report, EP 11854595.3, EP counterpart application, May 25, 2016.

* cited by examiner

AUXILIARY VALVE ACTUATING MECHANISM OF ENGINE

CROSS-REFERENCE TO RELATED APPLICATIONS

The present application is a national filing in the U.S. Patent & Trademark Office of International Patent Application PCT/CN2011/000769 filed May 3, 2011, and claims priority of Chinese Patent Application No. 201110001373.7 filed Jan. 5, 2011.

FIELD OF THE INVENTION

The present application relates to the mechanical field, specifically to vehicle engines, especially to the valve actuation technology for vehicle engines, particularly to an engine auxiliary valve actuation mechanism.

BACKGROUND OF THE INVENTION

In the prior art, the method of conventional valve actuation for a vehicle engine is well known and its application has more than one hundred years of history. However, due to the additional requirements on engine emission and engine braking, more and more engines need to produce an auxiliary engine valve event, such as an exhaust gas recirculation event or an engine braking event, in addition to the normal engine valve event. The engine brake has gradually become the must-have device for the heavy-duty commercial vehicle engines.

The engine braking technology is also well known. The engine is temporarily converted to a compressor, and in the conversion process the fuel is cut off, the exhaust valve is opened near the end of the compression stroke of the engine piston, thereby allowing the compressed gases (being air during braking) to be released. The energy absorbed by the compressed gas during the compression stroke cannot be returned to the engine piston at the subsequent expansion stroke, but is dissipated by the engine exhaust and cooling systems, which results in an effective engine braking and the slow-down of the vehicle.

There are different types of engine brakes. Typically, an engine braking operation is achieved by adding an auxiliary valve event for engine braking event into the normal engine valve event. Depending on how the auxiliary valve event is generated, an engine brake can be defined as:

1. Type I engine brake: the auxiliary valve event is introduced from a neighboring existing cam in the engine, which generates the so called Jake Brake;
2. Type II engine brake: the auxiliary valve event generates a lost motion type engine brake by altering existing cam profile, for example the integrated rocker arm brake;
3. Type III engine brake: the auxiliary valve event is produced from a dedicated brake cam, which generates a dedicated brake valve event via a dedicated brake rocker arm;
4. Type IV engine brake: the auxiliary valve event is produced by modifying the existing valve lift of the engine, which normally generates a bleeder type engine brake; and
5. Type V engine brake: the auxiliary valve event is produced by using a dedicated valve train to generate a dedicated valve (the fifth valve) engine brake.

An example of engine brake devices in the prior art is disclosed by Cummins in U.S. Pat. No. 3,220,392 in 1962. The engine brake system based on the patent has enjoyed a great commercial success. However, this engine brake system is a bolt-on accessory that fits above the engine. In order to mount the brake system, a spacer needs to be positioned between the cylinder and the valve cover. This arrangement may additionally increase height, weight, and cost to the engine.

The above engine brake system transmits a mechanical input to the exhaust valves to be opened through a hydraulic circuit. The hydraulic circuit generally includes a master piston reciprocating in a master piston hole, and the reciprocating motion comes from a mechanical input of the engine, such as the rocking of the injector rocker arm. Through hydraulic fluid, the motion of the master piston is transmitted to a slave piston located in the hydraulic circuit, thereby causing the slave piston to reciprocate in the slave piston hole. The slave piston acts, directly or indirectly, on the exhaust valves, thereby generating the valve event for the engine braking operation.

The conventional engine brake with hydraulic actuation has another drawback, i.e. the contractibility or deformation of the hydraulic system, which is relevant to the flexibility of the fluid. High flexibility greatly reduces the braking valve lift, the reduction of the braking valve lift leads to the increase of the braking load, and in turn the increased braking load further causes much higher flexibility, thereby forming a vicious circle. In addition, the braking valve lift reduction caused by the hydraulic deformation increases with the increase of the engine speed, which is against the braking valve lift trend required by the engine braking performance. In order to reduce the hydraulic flexibility, a hydraulic piston with a large diameter must be used, which increases the volume and weight. And, it will take a long time for the oil flow to drive such a large diameter piston to extend or retract, which increases the inertia and response time of the engine brake system.

One of the earliest engine brake systems integrated in the engine within the existing parts is disclosed in U.S. Pat. No. 3,367,312 by Jonsson in 1968, which is an integrated compression release engine brake system. The brake system is a lost motion type engine brake that needs to modify the conventional cam of the engine. In addition to enlarge the conventional cam lobe for power operation, brake cam lobes for engine braking are added on the same cam. The rocker arm of the brake system is installed on an eccentric cylinder surface of the rocker arm shaft. The rocking center position of the rocker arm is changed by rotating the rocker arm shaft, thereby causing or eliminating a gap for the "lost motion" between the cam and the engine valve. When the gap is formed, the motion from the braking cam lobes is lost, and the engine only generates power operation. When the gap is eliminated, the motion from all the cam lobes (the enlarged conventional cam lobe and the braking cam lobes) is transmitted to the engine valve, thereby producing the auxiliary valve event for the engine braking operation.

In Jonsson's brake system, when rotating an eccentric rocker arm shaft and changing the rocking center positions of all rocker arms, many valve spring forces on the rocker arm must be overcame, which results in a large hydraulic actuation system. Another drawback of the Jonsson's brake system comes from the enlarged conventional valve lift profile during the engine braking caused by the enlarged conventional cam lobe, which reduces the braking power and increases the injector tip temperature.

U.S. Pat. No. 5,335,636 (in 1994) discloses another integrated rocker brake system. The brake system also needs to modify the conventional cam of the engine. In addition to enlarge the conventional cam lobe for the power operation, a brake shoulder for the engine braking is added to the same cam. The brake shoulder is a cam lobe with a fixed (constant) height and can only be used for a bleeder type engine braking, and can not be used for the compression release engine braking. In addition, the rocker arm of the brake system is installed on an eccentric bushing, and the eccentric bushing is installed on the rocker arm shaft. By rotating the eccentric bushing and changing the rocking center position of the rocker arm, a gap for the "lost motion" is formed or eliminated between the cam and the engine valves. When the gap is formed, the motion from the braking shoulder on the cam is lost, and the engine only generates the power operation. When the gap is eliminated, the motion from all the cam lobes (the enlarged conventional cam lobe and the braking shoulder) is transmitted to the engine valve, thereby producing the auxiliary valve event for the engine braking operation. Also, the rocker arm of the brake system acts on a valve bridge and opens two valves simultaneously for the engine braking operation.

The above integrated rocker arm brake system still needs to enlarge the conventional cam lobe, which leads to an enlarged conventional valve lift during engine braking, a lower braking power and a higher injector tip temperature. In addition, the integrated rocker arm brake system can only be used for a bleeder type engine braking, and can not be used for a compression release type engine braking. The bleeder type engine braking has much lower braking performance than the compression release braking. Also, opening two valves for engine braking doubles the braking load on the entire valve actuation mechanism, which results in more wear and worse reliability and durability.

U.S. Pat. No. 5,647,319 (in 1997) discloses another integrated rocker brake system utilizing an eccentric bushing. The brake system is also a bleeder type engine brake, wherein the braking valve lift has a constant height, however the brake system has two different braking valve lifts. The smaller braking valve lift is used for low engine speeds (below 2000 rpm) and the higher braking valve lift is used for high engine speeds (above 2000 rpm). In addition, in all integrated rocker arm brake systems, the engine's ignition operation and braking operation share the same cam, and the existing conventional cam lobe needs to be modified, which may lead to an mutual influence between the ignition operation and the braking operation, a lower braking power, a higher injector tip temperature, an increased wear of valve train components, and a reduced engine reliability and durability.

SUMMARY OF THE INVENTION

An object of the present application is to provide an engine auxiliary valve actuation mechanism, which may solve the technical problems of integrated rocker brake systems in the prior art caused by the need to modify the existing conventional cam, that causing mutual influence between the ignition operation and the braking operation, the decreased braking power, the higher injector tip temperature, the increased wear of valve train components, and the reduced engine reliability and durability, and also solve the technical problems of increased engine height, weight and cost in a conventional engine brake device.

The present application provides an engine auxiliary valve actuation mechanism for producing an auxiliary valve event for an engine, the engine including a conventional valve actuation mechanism, the conventional valve actuation mechanism including a conventional cam, a conventional rocker arm shaft, a conventional rocker arm and a valve, a motion from the conventional cam being transmitted to the valve through the conventional rocker arm to generate a normal engine valve event, wherein the auxiliary valve actuation mechanism includes an auxiliary cam, an auxiliary rocker arm shaft, an auxiliary rocker arm, an eccentric rocker arm bushing and a bushing actuation device, the eccentric rocker arm bushing is disposed in an axial hole in the auxiliary rocker arm, the auxiliary rocker arm shaft is disposed in the eccentric rocker arm bushing, the auxiliary rocker arm shaft and the eccentric rocker arm bushing have offset axial centerlines, one end of the auxiliary rocker arm and the auxiliary cam are connected to form a kinematic pair, the other end of the auxiliary rocker arm is located above the valve, the bushing actuation device drives the eccentric rocker arm bushing to rotate between a non-operating position and an operating position, and in the non-operating position, a rocking centerline of the auxiliary rocker arm is away from the valve, and the auxiliary rocker arm is separated from the valve; and in the operating position, the rocking centerline of the auxiliary rocker arm is close to the valve, the auxiliary rocker arm is in contact with the valve, and a motion from the auxiliary cam is transmitted to the valve, thereby generating the auxiliary engine valve event.

Further, there is a phase difference between opening phases of the auxiliary valve event and the normal valve event, and the auxiliary valve event has a valve lift smaller than that of the normal valve event.

Further, the auxiliary cam includes a dedicated brake cam, the auxiliary rocker arm includes a dedicated brake rocker arm, and the auxiliary engine valve event includes an engine braking valve event.

Further, the auxiliary rocker arm shaft and the conventional rocker arm shaft is the same rocker arm shaft, and the auxiliary rocker arm and the conventional rocker arm are installed on the rocker arm shaft side by side.

Further, the bushing actuation device is a built-in actuation mechanism, the bushing actuation device is placed in the auxiliary rocker arm and adjacent to the eccentric rocker arm bushing; the built-in actuation mechanism includes an actuation piston located in the auxiliary rocker arm, and the actuation piston drives the eccentric rocker arm bushing to rotate between the non-operating position and the operating position.

Further, the bushing actuation device is an external actuation mechanism, the external actuation mechanism includes an actuation member located outside of the auxiliary rocker arm, and the actuation member drives the eccentric rocker arm bushing to rotate between the non-operating position and the operating position.

Further, the bushing actuation device is a continuously variable actuation mechanism, the continuously variable actuation mechanism drives the eccentric rocker arm bushing, and the eccentric rocker arm bushing has a continuously adjustable operating position.

Further, the auxiliary valve actuation mechanism includes an auxiliary spring, the auxiliary spring being configured to bias the auxiliary rocker arm on a position to avoid an impact with the valve.

The working principle of the present application is as follows, when the auxiliary engine valve event is needed to produce engine braking, an engine brake controller is turned on to supply engine oil to the auxiliary valve actuation mechanism. Oil pressure acts on the bushing actuation device, and the bushing actuation device drives the eccentric rocker arm bushing to rotate from the non-operating position to the operating position. The rocking centerline of the auxiliary rocker arm moves (downward) near to the engine valve, thereby eliminating the gap between the auxiliary cam and the engine valve, such that the auxiliary rocker arm is connected to the engine valve. The motion from the auxiliary cam is transmitted to the engine valve, thereby producing the auxiliary engine valve event for engine braking. When engine braking is not needed, the engine brake controller is turned off to drain oil. The bushing actuation device of the auxiliary valve actuation mechanism moves the eccentric rocker arm bushing from the operating position back to the non-operating position. The rocking centerline of the auxiliary rocker arm moves (upward) away from the engine valve, thereby forming the gap between the auxiliary cam and the engine valve to separate the auxiliary rocker arm from the engine valve. The motion of the auxiliary cam can not be transmitted to the engine valve, the engine is disengaged from the braking operation and back to the normal (ignition) operation.

The present application has positive and significant effects over the prior art. The present application provides an auxiliary valve actuation mechanism independent from the conventional valve actuation mechanism, which includes a dedicated brake cam and a dedicated brake rocker arm. There is no need to modify the existing conventional cam, and there is also no need to increase the conventional valve lift during the engine braking, thereby eliminating the mutual influence between the engine's ignition operation and braking operation, increasing the braking power, decreasing the injector tip temperature, reducing the wear of valve train components, and improving the engine reliability and durability. The engine brake device of the present application with the dedicated brake cam and the dedicated brake rocker arm has many advantages, such as superior performance, simple structure, easy installation, low cost and good reliability and durability.

DETAILED DESCRIPTION OF THE EMBODIMENTS

First Embodiment

Figure 1:
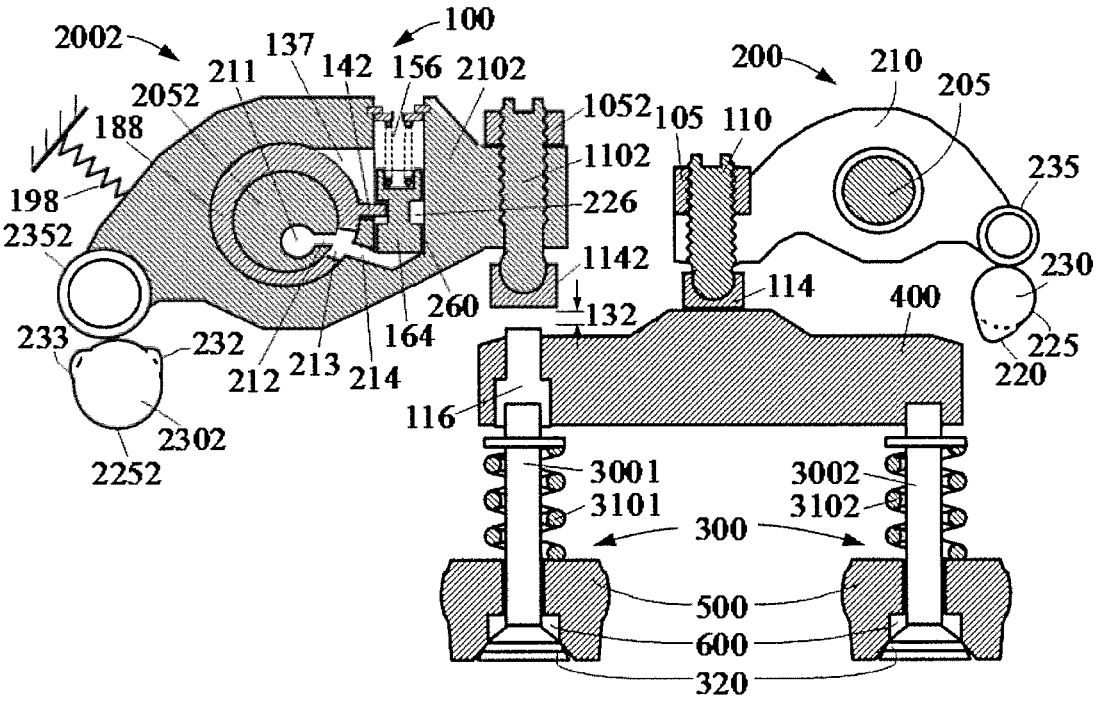
FIG. 1 is a schematic view showing an engine auxiliary valve actuation mechanism according to one embodiment of the present application.
Figure 3:
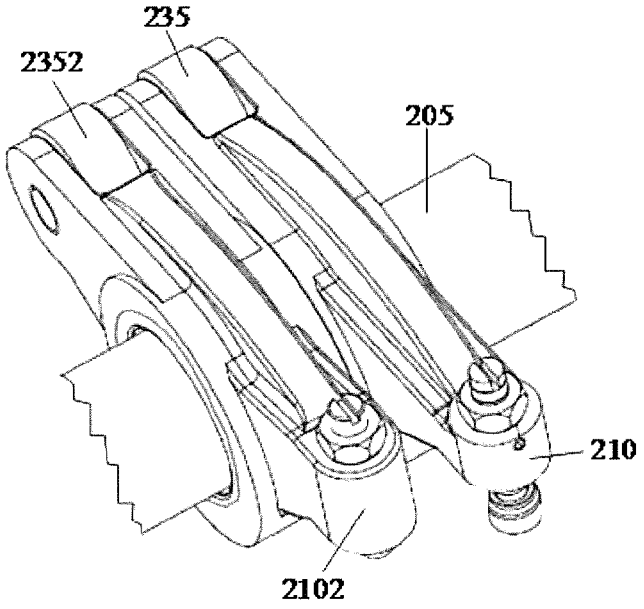
FIG. 3 is a schematic diagram illustrating an arrangement positional relationship between an auxiliary rocker arm of the engine auxiliary valve actuation mechanism and a conventional rocker arm according to the present application.
Figure 4:
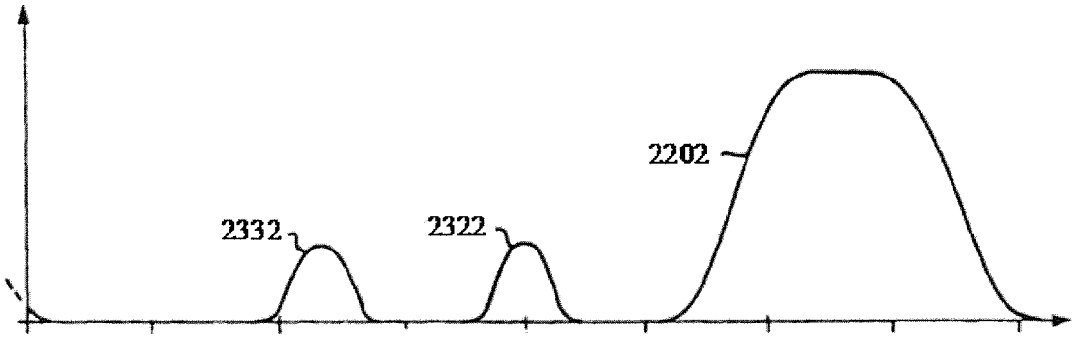
FIG. 4 is a schematic diagram illustrating a conventional valve lift profile and an auxiliary valve lift profile (engine brake valve lift) of the engine auxiliary valve actuation mechanism according to one embodiment of the present application.

As shown in FIGS. 1, 3 and 4, an auxiliary valve actuation mechanism in the present embodiment is an engine brake mechanism, and an auxiliary engine valve event produced by the auxiliary valve actuation mechanism is an exhaust valve event for engine braking. A normal valve event for the normal (ignition) engine operation is generated by a conventional valve actuation mechanism 200. The conventional valve actuation mechanism 200 and the auxiliary valve actuation mechanism 2002 are two mechanisms independent from each other.

The conventional valve actuation mechanism 200 includes many components, including a conventional cam 230, a cam follower 235, a conventional rocker arm 210, a valve bridge 400 and exhaust valves 300. Exhaust valves 300 consist of a valve 3001 and a valve 3002, and the exhaust valves 300 are biased against valve seats 320 on an engine cylinder block 500 by engine valve springs 3101 and 3102 so as to control the gas flowing between an engine cylinder (not shown) and exhaust manifolds 600. The conventional rocker arm 210 is pivotally mounted on a conventional rocker arm shaft 205 for transmitting motion from the conventional cam 230 to the exhaust valves 300 for cyclic opening and closing of the exhaust valves 300. The conventional valve actuation mechanism 200 also includes a valve lash adjusting screw 110 and an elephant foot pad 114. The valve lash adjusting screw 110 is fixed on the conventional rocker arm 210 by a nut 105. The conventional cam 230 has a conventional cam lobe 220 on an inner base circle 225 to generate the conventional valve lift profile (see 2202 in FIG. 4) for the conventional engine (ignition) operation.

The auxiliary valve actuation mechanism 2002 includes an auxiliary cam 2302 (which is a dedicated brake cam in the present embodiment), an auxiliary cam follower 2352, an auxiliary rocker arm shaft 2052, an auxiliary rocker arm 2102 (which is a dedicated brake rocker arm in the present embodiment), an eccentric rocker arm bushing 188 and a bushing actuation device 100. The eccentric rocker arm bushing 188 is disposed between the auxiliary rocker arm shaft 2052 and the dedicated brake rocker arm 2102, and is provided with a protruding portion 142 of a pin-like shape (the protruding portion can also be a pin installed on the eccentric rocker arm bushing separately) placed in a cutting groove 137 in the dedicated brake rocker arm 2102. One end of the dedicated brake rocker arm 2102 is connected to the dedicated brake cam 2302 through the auxiliary cam follower 2352, and the other end thereof is located above the exhaust valve 3001. In the present embodiment, a brake pressing block 116 in the valve bridge 400 and above the exhaust valve 3001 is an optional component. That is to say, the dedicated brake rocker arm 2102 can act directly on the valve bridge 400 or on the exhaust valve 3001 and an extended valve stem thereof. The auxiliary valve actuation mechanism 2002 also includes a brake valve lash adjusting screw 1102 and an elephant foot pad 1142. The brake valve lash adjusting screw 1102 is fixed on the dedicated brake rocker arm 2102 by a nut 1052. The dedicated brake rocker arm 2102 is generally biased onto the dedicated brake cam 2302 by a brake spring 198 so as to avoid any impact between the dedicated brake rocker arm 2102 and the exhaust valve 3001.

The dedicated brake cam 2302 has dedicated brake cam lobes 232 and 233 on the inner base circle 2252 for producing valve compression release and exhaust gas recirculation of the exhaust valve respectively. Cam lobes 232 and 233 are used to generate the auxiliary valve lift profiles for engine braking (see 2322 and 2332 in FIG. 4). In the present embodiment, the brake cam lobe 233 for exhaust gas recirculation is an optional component.

The bushing actuation device 100 of the auxiliary valve actuation mechanism 2002 is a hydraulic actuation system, including a brake controller (not shown), an actuation piston 164 located in a piston hole 260 of the dedicated brake rocker arm 2102, and a fluid network connecting the brake controller and the actuation piston 164. The fluid network includes an axial fluid passage 211 and a radial fluid passage 212 in the auxiliary rocker arm shaft 2052, a fluid passage 213 in the eccentric rocker arm bushing 188, and a fluid passage 214 in the dedicated brake rocker arm 2102. An annular groove 226 is provided on the actuation piston 164. The protruding portion 142 on the bushing 188 fits into the annular groove 226, such that a linear motion of the actuation piston 164 is converted into a rotation of the eccentric rocker arm bushing 188 on the auxiliary rocker arm shaft 2052. The actuation piston 164 is generally biased downward by a spring 156 (see FIG.

1), and when the eccentric rocker arm bushing 188 is in an non-operating position (the thinnest part of the eccentric rocker arm bushing 188 is located at the lowest point of the auxiliary rocker arm shaft 2052), a rocking centerline of the dedicated brake rocker arm 2102 is at the highest position, and the dedicated brake rocker arm 2102 is away from the exhaust valve 3001 (or away from an opening direction of the exhaust valve 3001). A gap 132 is formed between the dedicated brake cam 2302 and the exhaust valve 3001, thus the motion from the dedicated brake cam lobes 232 and 233 cannot be transmitted to the exhaust valve 3001, and the entire engine brake mechanism is separated from the normal engine operation.

When the auxiliary engine valve event is needed, i.e. the engine braking is needed, the engine brake controller is turned on to supply oil to the auxiliary valve actuation mechanism. Engine Oil flows through the fluid network, including fluid passages 211, 212, 213 and 214, and then flows to the actuation piston 164. Oil pressure overcomes a force of the spring 156 and pushes the actuation piston 164 in the piston hole 260 upwards. The annular groove 226 on the actuation piston 164 drives, via the protruding portion 142, the eccentric rocker arm bushing 188 to rotate on the stationary auxiliary rocker arm shaft 2052 from the non-operating position shown in FIG. 1 to an operating position (a wall thickness of the eccentric rocker arm bushing 188 at the lowest point of the auxiliary rocker arm shaft 2052 is increased). The rocking centerline of the dedicated brake rocker 2102 gets close to (downward) the exhaust valve 3001 (or gets close to the opening direction of the exhaust valve 3001), thereby eliminating the gap 132 between the dedicated brake cam 2302 and the exhaust valve 3001, such that the dedicated brake rocker arm 2102 and the exhaust valve 3001 are connected. The motion from the dedicated brake cam lobes 232 and 233 is transmitted to the exhaust valve 3001, thereby producing the auxiliary engine valve event for engine braking.

When engine braking is not needed, the engine brake controller is turned off to drain oil. The spring 156 pushes the actuation piston 164 downward into the piston hole 260. The annular groove 226 on the actuation piston 164 drives, via the protruding portion 142, the eccentric rocker arm bushing 188 to move from the operating position back to the non-operating position shown in FIG. 1. The rocking centerline of the dedicated brake rocker arm 2102 is away from (upwards) the exhaust valve 3001, thereby forming the gap 132 between the dedicated brake cam 2302 and the exhaust valve 3001, such that the dedicated brake cam 2302 is separated from the exhaust valve 3001. The motion from the dedicated brake cam 2302 can not be transmitted to the exhaust valve 3001, and the engine is disengaged from the braking operation and back to the normal (ignition) operation.

FIG. 3 is a schematic diagram showing an arrangement relationship between the auxiliary rocker arm and the conventional rocker arm. The auxiliary rocker arm shaft 2052 of the auxiliary exhaust valve actuation mechanism 2002 in FIGS. 1 and 2 and the conventional rocker arm shaft 205 of the conventional exhaust valve actuation mechanism 200 share the same rocker arm shaft. At this point, the auxiliary rocker arm, i.e. the dedicated brake rocker arm 2102, and the conventional rocker arm 210 are installed side-by-side on the conventional rocker arm shaft 205, thereby forming a positional relationship shown in FIG. 3.

Of course, other arrangements (left and right, up and down, inside and outside, and etc.) are also possible.

FIG. 4 is a schematic diagram illustrating a conventional valve lift profile 2202 and auxiliary valve lift (i.e. the engine brake valve lift) profiles 2322 and 2332 of the engine auxiliary valve actuation mechanism according to one embodiment of the present application. The conventional valve lift profile 2202 corresponds to the conventional cam lobe 220 on the inner base circle 225 of the conventional cam 230 in FIG. 1, which is generated by the conventional valve actuation mechanism 200. The auxiliary valve lift (i.e. the engine brake valve lift) profiles 2322 and 2332 correspond to the dedicated brake cam lobes 232 and 233 on the inner base circle 2252 of the dedicated brake cam 2302 in FIG. 1, which is generated by the dedicated brake rocker arm 2102.

In FIG. 4, the conventional valve lift profile 2202 and the auxiliary valve lift profiles 2322 and 2332 are separated, that is, opening phases of the two valve events are staggered. The conventional rocker arm 210 is stationary when the dedicated brake cam 2302 actuates the dedicated brake rocker arm 2102. The valve lift (i.e. the opening magnitude) of the auxiliary valve lift profiles 2322 and 2332 is less than that of the conventional valve lift profile 2202. The conventional valve lift profile (timing and the opening magnitude) 2202 is enlarged during braking operation in the integrated rocker arm brake systems in the prior art, which may cause the decline of engine braking power and the increase of injector tip temperature. Since the auxiliary exhaust valve actuation mechanism 2002 and the conventional exhaust valve actuation mechanism 200 of the present application are two mechanism independent from each other, the conventional valve lift profile 2202 (timing and the opening magnitude) will not be enlarged during engine braking operation. That is, the conventional valve lift profile 2202 will be the same during both the normal (ignition) engine operation and the engine braking operation. Therefore, the present application eliminates the drawbacks of the integrated rocker arm brake systems in the prior art, that the braking power is decreased and the injector tip temperature is increased.

Second Embodiment

Figure 2:
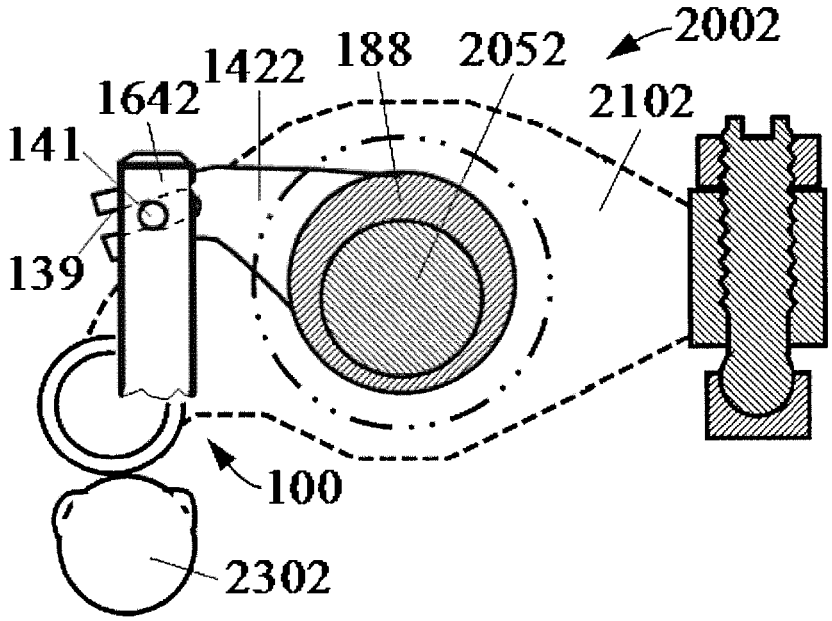
FIG. 2 is a schematic view showing an engine auxiliary valve actuation mechanism according to another embodiment of the present application.

FIG. 2 is a schematic view showing an auxiliary valve actuation mechanism according to a second embodiment of the present application. The difference between this embodiment and the first embodiment lies in the bushing actuation device 100. The first embodiment has a built-in type of bushing actuation device 100, with the actuation piston 164 locating in the auxiliary rocker arm (i.e. the dedicated brake rocker arm) 2102 (see FIG. 1). The present embodiment has an externally driven type of bushing actuation device 100, wherein the eccentric rocker arm bushing 188 has a swing arm 1422 (see FIG. 2) being provided with a pin slot 139. Through a pin 141 located in the pin slot 139, an actuation member (which is an actuation rod herein) 1642 of the bushing actuation device 100 located outside of the auxiliary rocker arm (i.e. the dedicated brake rocker arm) 2102 drives the eccentric rocker arm bushing 188 to rotate between the non-operating position and the operating position. The actuation rod 1642 can be an extension of the actuation piston or other actuation members, such as an actuation wire. The bushing actuation device 100 can have various forms, from a simple, manually operated bicycle brake wire actuation mechanism to an automatic continuously variable actuation mechanism, and can be mechanical, hydraulic, electromagnetic or a combination of several forms. When the bushing actuation device 100 employs a continuously variable actuation mechanism, a rotation range (i.e. the operating position) of the eccentric rocker arm bushing 188 is continuously adjustable, and the engine exhaust valve lift (i.e. the opening) is also continuously adjustable. Such that during the engine braking operation, the braking valve lift can be adjusted according to the engine speed and the braking load so as to optimize the braking performance.

In the present application, the conventional exhaust valve actuation mechanism 200 (see FIG. 1) and the auxiliary exhaust valve actuation mechanism 2002 (see FIGS. 1 and 2) are two mechanisms independent from each other, thereby eliminating the mutual influence between the normal (ignition) operation and the engine braking operation of the integrated rocker arm brake systems in the prior art. For example, during the startup and shutdown processes of the integrated rocker arm brake system in the prior art, an integrated rocker arm and an internal eccentric bushing thereof will withstand the forces imposed by the exhaust valves (the valve spring force and the cylinder pressure), which causes startup and shutdown difficulties and longer reaction time of engine braking. Also, in the prior art, the normal engine (ignition) operation and the engine braking operation share the same cam and the same rocker arm, thus the braking components, such as the eccentric rocker arm bushing, have much higher operating frequencies and increased probability of failure due to wear. The auxiliary exhaust valve actuation mechanism 2002 of the present application, using the dedicated brake cam 2302 and the dedicated brake rocker arm 2102, will not withstand the force imposed by the exhaust valves in the processes of startup and shutdown (as shown in FIG. 1, the exhaust valves are pushed away by the conventional exhaust valve actuation mechanism 200 to be separated from the dedicated brake rocker arm 2102), such that the required actuation force and the reaction time for braking operation are reduced. The braking components of the present application, such as the eccentric bushing, the dedicated brake cam 2302 and the dedicated brake rocker arm 2102, has operating frequencies much lower than the ignition frequency (operating frequencies are less than 10% of the ignition frequency). The wear and failure probability decreases, and the engine reliability and durability are greatly increased.

While the above description contains many specific embodiments, these embodiments should not be regarded as limitations on the scope of the present application, but rather as specific exemplifications of the present application. Many other variations are likely to be derived from the specific embodiments. For example, the auxiliary valve actuation mechanism described herein can be used to produce the auxiliary engine valve event not only for engine braking, but also for exhaust gas recirculation and other auxiliary engine valve events.

In addition, the auxiliary valve actuation mechanism described herein can be used not only for overhead cam engines, but also for push rod/tubular engines, and can not only be used to actuate the exhaust valves, but also be used to actuate the intake valves.

Also, the auxiliary valve actuation mechanism described herein can be used not only to actuate a single valve, but also to actuate multiple valves, such as dual valves.

Therefore, the scope of the present application should not be defined by the above-mentioned specific examples, but by the appended claims and their legal equivalents.

What is claimed is:

1. An engine auxiliary valve actuation mechanism for producing an auxiliary valve event for an engine comprising a first valve actuation mechanism including a first cam, a first rocker arm shaft, a first rocker arm and a valve, a motion from a first cam being transmitted to the valve through a first rocker arm to generate a normal engine valve event, wherein the auxiliary valve actuation mechanism comprises:

an auxiliary cam;

an auxiliary rocker arm shaft;

an auxiliary rocker arm;

an eccentric rocker arm bushing; and a bushing actuation device, wherein the bushing actuation device is placed in the auxiliary rocker arm, wherein the eccentric rocker arm bushing is disposed in an axial hole in the auxiliary rocker arm, the auxiliary rocker arm shaft being disposed in the eccentric rocker arm bushing with the auxiliary rocker arm shaft and the eccentric rocker arm bushing having offset axial centerlines, one end of the auxiliary rocker arm and the auxiliary cam being connected to form a kinematic pair and the other end of the auxiliary rocker arm being located above the valve, and wherein the bushing actuation device drives the eccentric rocker arm bushing to rotate between a non-operating position and an operating position, whereupon in the non-operating position, a rocking centerline of the auxiliary rocker arm is displaced away from the valve, and the auxiliary rocker arm is separated from the valve; and in the operating position, the rocking centerline of the auxiliary rocker arm is proximate to the valve, the auxiliary rocker arm is in contact with the valve and a motion from the auxiliary cam is transmitted to the valve, thereby generating the auxiliary engine valve event.

2. The engine auxiliary valve actuation mechanism according to claim 1, wherein there is a phase difference between opening phases of the auxiliary valve event and the normal engine valve event, and the auxiliary valve event has a valve lift smaller than that of the normal engine valve event.

3. The engine auxiliary valve actuation mechanism according to claim 1, wherein the auxiliary cam comprises a dedicated brake cam, the auxiliary rocker arm comprises a dedicated brake rocker arm, and the auxiliary engine valve event comprises an engine braking valve event.

4. The engine auxiliary valve actuation mechanism according to claim 1, wherein the actuation mechanism comprises an actuation piston located in the auxiliary rocker arm, and the actuation piston drives the eccentric rocker arm bushing to rotate between the non-operating position and the operating position.

5. The engine auxiliary valve actuation mechanism according to claim 1, wherein the bushing actuation device is a continuously variable actuation mechanism, the continuously variable actuation mechanism drives the eccentric rocker arm bushing, and the eccentric rocker arm bushing has a continuously adjustable operating position.

6. The engine auxiliary valve actuation mechanism according to claim 1, further comprising an auxiliary spring, the auxiliary spring being configured to bias the auxiliary rocker arm on a position to avoid an impact with the valve.

7. An engine auxiliary valve actuation mechanism for producing an auxiliary valve event for an engine comprising a first valve actuation mechanism including a first cam, a first rocker arm shaft, a first rocker arm and a valve, a motion from a first cam being transmitted to the valve through a first rocker arm to generate a normal engine valve event, wherein the auxiliary valve actuation mechanism comprises:

an auxiliary cam;

an auxiliary rocker arm, wherein the auxiliary rocker arm and the first rocker arm are installed on the first rocker arm shaft side by side;

an eccentric rocker arm bushing; and a bushing actuation device, wherein the bushing actuation device is placed in the auxiliary rocker arm, wherein the eccentric rocker arm bushing is disposed in an axial hole in the auxiliary rocker arm, the first rocker arm shaft being disposed in the eccentric rocker arm bushing with the first rocker arm shaft and the eccentric rocker arm bushing having offset axial centerlines, one end of the auxiliary rocker arm and the auxiliary cam being connected to form a kinematic pair and the other end of the auxiliary rocker arm being located above the valve, and wherein the bushing actuation device drives the eccentric rocker arm bushing to rotate between a non-operating position and an operating position, whereupon in the non-operating position, a rocking centerline of the auxiliary rocker arm is displaced away from the valve, and the auxiliary rocker arm is separated from the valve; and in the operating position, the rocking centerline of the auxiliary rocker arm is proximate to the valve, the auxiliary rocker arm is in contact with the valve and a motion from the auxiliary cam is transmitted to the valve, thereby generating the auxiliary engine valve event.

* * * * *